US006631820B2

(12) United States Patent
Harrold et al.

(10) Patent No.: US 6,631,820 B2
(45) Date of Patent: Oct. 14, 2003

(54) TAMPER-EVIDENT DISPENSING CLOSURE WITH PARTIAL BREAKAWAY COVER

(75) Inventors: John E. Harrold, Bloombury, NJ (US); Bruce M. Mueller, Brookfield, WI (US); Richard A. Gross, Oconomowoc, WI (US)

(73) Assignee: Seaquist Closures Foreign, Inc., Crystal Lakes, IL (US)

( * ) Notice: Subject to any disclaimer, the term of this patent is extended or adjusted under 35 U.S.C. 154(b) by 0 days.

(21) Appl. No.: 09/748,630

(22) Filed: Dec. 22, 2000

(65) Prior Publication Data

US 2002/0079282 A1 Jun. 27, 2002

(51) Int. Cl.[7] ..... B65D 41/34

(52) U.S. Cl. ..... 215/237; 215/230; 215/235; 215/250; 215/252; 215/253; 220/837; 220/268; 220/838; 222/556; 222/541.6; 222/541.5; 222/153.06; 222/153.14

(58) Field of Search ..... 222/153.05, 153.06, 222/153.07, 153.09, 153.14, 541.1, 541.5, 541.6, 541.9, 556, 570; 215/252, 237, 235, 253, 250, 258, 230; 220/266, 268, 847, 833, 834, 836–838, 784

(56) References Cited

U.S. PATENT DOCUMENTS

| | | | |
|---|---|---|---|
| 1,333,334 | A | 3/1920 | Nesmith |
| 3,059,816 | A | 10/1962 | Goldstein |
| 3,255,928 | A | 6/1966 | Foster |
| 3,272,368 | A | 9/1966 | Baarn |
| 3,341,046 | A | 9/1967 | Bereziat et al. |
| 3,441,161 | A | 4/1969 | Baarn |
| 3,480,184 | A | 11/1969 | Landis |
| 3,850,329 | A | 11/1974 | Robinson |
| 3,860,148 | A | 1/1975 | Sherin |
| 3,976,215 | A | 8/1976 | Smalley |
| 3,986,627 | A | 10/1976 | Zapp |
| 3,990,598 | A | 11/1976 | Zapp et al. |
| 4,024,976 | A | 5/1977 | Acton |
| 4,062,466 | A | 12/1977 | Conti |
| 4,081,108 | A | 3/1978 | Wilson et al. |
| 4,129,226 | A | 12/1978 | Percival |
| 4,153,174 | A | 5/1979 | Keeler |
| 4,170,315 | A | 10/1979 | Dubach et al. |
| 4,193,519 | A | 3/1980 | Dubach et al. |
| 4,196,818 | A | 4/1980 | Brownbill |
| 4,244,495 | A | 1/1981 | Lorscheid et al. |
| 4,262,814 | A | 4/1981 | Roccaforte |

(List continued on next page.)

FOREIGN PATENT DOCUMENTS

| | | |
|---|---|---|
| AU | 71/35561 | 11/1971 |
| DE | 2155664 | 6/1972 |
| EP | 141591 A2 * | 5/1985 |
| EP | 0 251 123 | 7/1988 |

OTHER PUBLICATIONS

U.S. patent application Ser. No. 09/747,865, filed Dec. 22, 2000.

*Primary Examiner*—Robin Hylton
(74) *Attorney, Agent, or Firm*—Wood, Phillips, Katz, Clark & Mortimer

(57) ABSTRACT

A closure structure includes a closure body having a deck and depending sidewall, and a dispensing orifice through said deck. A closure cap has a lid part attached by a hinge to the body, and a cover part frangibly connected to the lid part, on a side of the lid part opposite the hinge. The lid part is latched to the body at lateral positions located between the hinge and the cover part. The cover part covers a lifting lip extending from the lid part. Removal of the cover part exposes the lifting lip for lifting by the user to open the lid part from the closure body.

7 Claims, 9 Drawing Sheets

U.S. PATENT DOCUMENTS 4,299,328 A 11/1981 Ochs
4,310,105 A * 1/1982 Gach ..... 222/153.09
4,345,692 A 8/1982 Obrist et al.
4,353,483 A 10/1982 Pehr
4,371,088 A 2/1983 Gach
4,418,828 A 12/1983 Wilde et al.
4,420,089 A 12/1983 Walker et al.
RE31,496 E 1/1984 Keeler
4,449,631 A 5/1984 Levenberg et al.
4,467,931 A 8/1984 Gach
4,487,324 A 12/1984 Ostrowsky
4,629,081 A 12/1986 McLaren
4,696,408 A 9/1987 Dubach
4,709,823 A 12/1987 Beck et al.
4,718,567 A 1/1988 Vange
4,782,964 A 11/1988 Poore
4,787,530 A 11/1988 Edwards
4,795,044 A 1/1989 Beck
4,821,898 A * 4/1989 Smalley ..... 215/237
4,919,286 A 4/1990 Agbay, Sr.
4,941,592 A 7/1990 Kitterman
4,974,735 A 12/1990 Newell
4,986,430 A 1/1991 Dutt
5,058,775 A 10/1991 Gross et al.
5,115,934 A 5/1992 Nelson
5,123,561 A 6/1992 Gross
5,137,260 A 8/1992 Pehr
5,141,138 A 8/1992 Odet et al.
5,147,054 A 9/1992 Pehr
5,201,440 A 4/1993 Gross
5,356,017 A 10/1994 Rohr et al.
5,356,018 A 10/1994 Dubach
5,386,918 A 2/1995 Neveras
5,392,938 A 2/1995 Dubach
5,427,260 A 6/1995 Mueller et al.
5,465,876 A 11/1995 Crisci
5,605,240 A 2/1997 Guglielmini
5,685,444 A * 11/1997 Valley ..... 215/237
5,735,419 A 4/1998 Ma
5,775,528 A 7/1998 Wohlgemuth
5,785,209 A 7/1998 Guglielmini
5,853,093 A 12/1998 Neiger
5,860,545 A 1/1999 Bartsch
5,875,906 A 3/1999 Price et al.
5,875,907 A 3/1999 Lay
5,875,942 A 3/1999 Ohmi et al.
5,938,054 A 8/1999 Loader
5,984,125 A 11/1999 Price et al.
5,992,659 A 11/1999 Nofer et al.
6,003,712 A 12/1999 Mogard et al.
6,116,441 A * 9/2000 Decelles et al. ..... 215/237
6,234,334 B1 * 5/2001 Suarez ..... 215/237
6,269,986 B1 * 8/2001 Gross ..... 222/541.5
6,405,885 B1 * 6/2002 Elliott ..... 215/237

* cited by examiner

FIG. 17
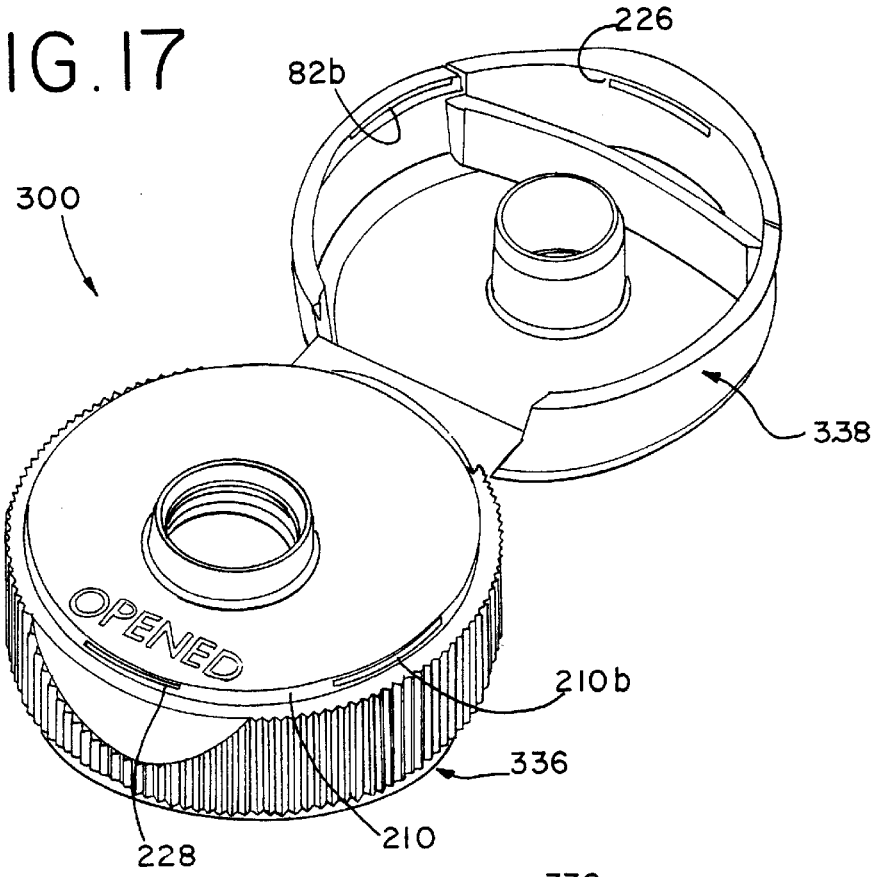
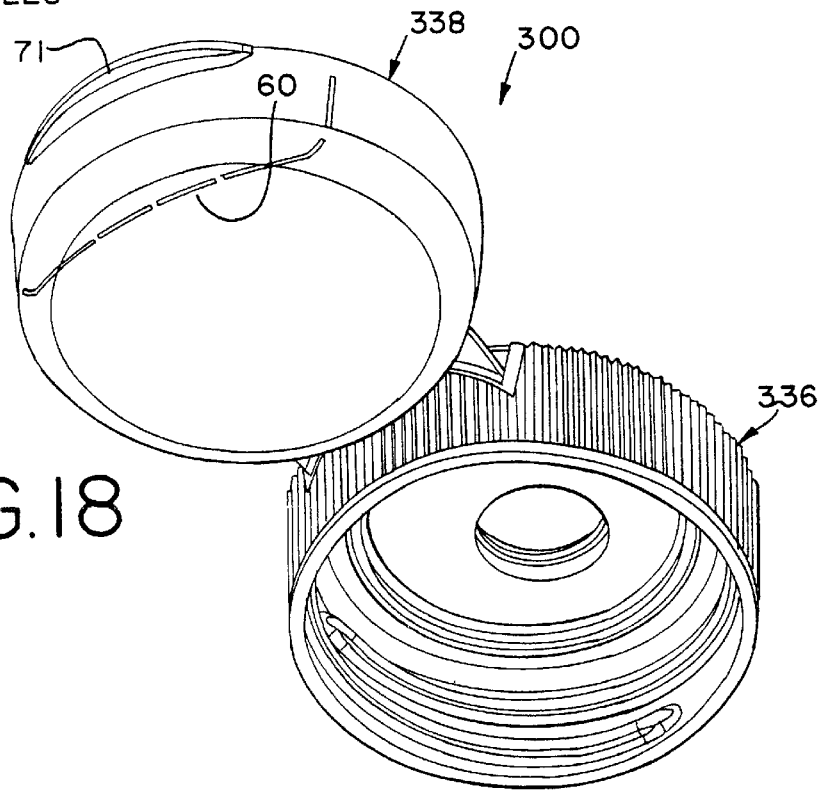
FIG. 18

TAMPER-EVIDENT DISPENSING CLOSURE WITH PARTIAL BREAKAWAY COVER

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The invention relates to closure structures. Particularly, the invention relates to a closure structure that has a closure body defining a dispensing orifice, and an associated hinged lid. The invention particularly relates to such closure structures wherein a tamper-evident feature is associated with the closure body and the lid, the tamper-evident feature preventing opening of the lid unless the tamper-evident feature is torn or otherwise broken.

BACKGROUND OF THE INVENTION AND TECHNICAL PROBLEMS POSED BY THE PRIOR ART

A variety of container closures have been developed or proposed wherein an initial opening of a lid or a dispensing spout structure provides visual evidence of such an occurrence-even after the lid or spout has been subsequently closed.

Some types of tamper-evident systems require an overt action by the user such as removing an added component such as a removable "neck band" or the like. Other tamper-evident systems require removing or breaking an integral element such as a "tear away" feature to permit removal of the closure or to otherwise open the container. Some examples of such systems are represented by U.S. Pat. Nos. 4,487,324; 5,058,775; 5,201,440; 5,427,260; and 5,875,907.

Other types of tamper-evident systems are more automatic in their function. As the user opens the package, such as by removing the closure from the container, an integral component of the closure is irreparably broken in such a way that it is evident the original seal has been breached. Some examples of such systems are represented by U.S. Pat. Nos. 4,196,818; 4,153,174; and 5,875,906.

While the above mentioned closures can function well for the purposes for which they have been designed, the present inventors have recognized that it would be desirable to provide an improved tamper-evident closure which could be readily fabricated to associate with certain types of lids or flow control elements and which, prior to initial opening, could enhance the cosmetic appearance of the closure. The present inventors have recognized that it would be desirable if such a tamper-evident closure could be easily installed on a container to its tamper-indicating ready condition for eventual delivery to the consumer. The present inventors have recognized that it would be desirable to provide a tamper-evident closure that was easy and self-explanatory to use by consumers while still providing an attractive appearance, ease of application by packagers, and simplicity in molding by the closure producer.

BRIEF SUMMARY OF THE INVENTION

The invention provides a closure structure having an appearance that leads the user to attempt to open the container in the usual manner. In doing so, however, a first tamper-evident element, a cover part, is automatically removed from the closure structure. This exposes an indication that the dispensing seal of the closure structure may have been opened and also provides a convenient secondary means of opening a lid part for continuing use of the package.

Furthermore, if the overall design of the package so dictates, or if the user so elects, the entire closure structure may be removed from the container before or after the first tamper-evident element is removed. In this event, a second tamper-evident element is automatically separated from the closure structure, and remains on the container, thereby revealing that the closure/container interface has been breached.

The present invention provides a closure structure having a closure body with a dispensing orifice, and a cap which is configured to overlie the closure body. The cap includes a lid part and a cover part connected together by a frangible feature. The lid part is hinged to the closure body. The lid and cover parts as a unit can be pivoted from an initially open, as-molded, orientation to a position wherein the parts lock onto the closure body. The frangible feature, and the locking of the parts onto the closure body, constitute a tamper-evident feature which must be discernibly breached to initially gain access to the dispensing orifice.

The frangible feature preferably comprises a line of weakness formed through the material of the cap, such as formed by a through-cut or groove made discontinuous by small, breakable bridging webs.

According to an exemplary embodiment, the closure body comprises a flat end wall or deck and a depending annular body sidewall or body skirt. An annular shoulder is formed above the sidewall. The lid part includes a first partially circular top wall and a depending first partially annular lid sidewall or lid skirt. The lid skirt includes an edge which fits on the annular shoulder when the lid part is closed onto the closure body. The lid skirt and the closure body provide first and second latching mechanisms arranged on opposing sides of the hinge respectively, around a circumference of the lid part.

The cover part includes a second partially circular top wall and a second partially annular skirt which substantially complete, with the first partially circular top wall and the first partially annular skirt of the lid part, an overall circular top wall and an overall annular skirt of the cap. A third latching mechanism is arranged between the cover part and the closure body at a front side of the closure structure, opposite to the hinge.

Guard walls can be arranged on the annular shoulder, which form partially annular channels for receiving edge portions of the lid skirt. The guard walls prohibit the de-latching of the lid part by someone attempting to separate the lid edge from the closure body using a predominantly radial force.

To open the closure structure for the first time, the cover part is pried upwardly, causing the breaking of the line of weakness, and a separation of the cover part from the lid part. Removal of the cover part exposes a front wall of the lid part, and a lifting lip that extends forwardly from the front wall. In order to open the lid part, the user then exerts an upwardly directed force on the lifting lip to cause a progressive separation of the two latching mechanisms and opening of the lid part.

An important advantage to the manufacturer of the inventive closure structure is that molding thereof may be accomplished without any unusual or complicated features in the injection mold used to form the structure. All surfaces may be formed by standard "straight opening" molds. No complicated side actions, etc., are required. The closure structure is cost effectively manufactured.

Advantages of the inventive closure structure also accrue to the packager and retailer. In handling of the parts during completion of the closure preparation, subsequent bulk handling and shipment, and application to containers, the absence of appendages or features that project beyond the outside surfaces of the closure structure allow the parts to be easily and efficiently handled throughout the distribution chain. Once on the container, the closure structure presents a smooth, aesthetically pleasing appearance to potential purchasers at point of sale.

The closure structure of the invention is simple and user friendly. The initial opening movement is familiar to the user, and the opening sequence is self-explanatory.

Numerous other advantages and features of the present invention will become readily apparent from the following detailed description of the invention, from the claims, and from the accompanying drawings.

BRIEF DESCRIPTION OF THE DRAWINGS

The accompanying drawings form part of the specification, and like numerals are employed to designate like parts throughout the same.

FIG. 17 is a top perspective view of an alternate embodiment closure structure; and FIG. 18 is a bottom perspective view of the alternate embodiment closure structure of FIG. 17.

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, most of the figures illustrating the invention show a dispensing system in the typical orientation that it would have at the top of a container when the container is stored upright on its base, and terms such as upper, lower, horizontal, etc., are used with reference to this position. It will be understood, however, that the dispensing system of this invention may be manufactured, stored, transported, used, and sold in an orientation other than the position described.

The dispensing system of this invention is suitable for use with a variety of conventional or special containers having various designs, the details of which, although not illustrated or described, would be apparent to those having skill in the art and an understanding of such containers. The container per se described herein forms no part of some embodiments and concepts of the invention and therefore is not intended to limit the present invention. It will also be understood by those of ordinary skill that novel and non-obvious inventive aspects are embodied in the described exemplary closure structure alone.

An exemplary embodiment of a closure structure 30 according to the invention is illustrated in FIGS. 1–16.

Figure 1:
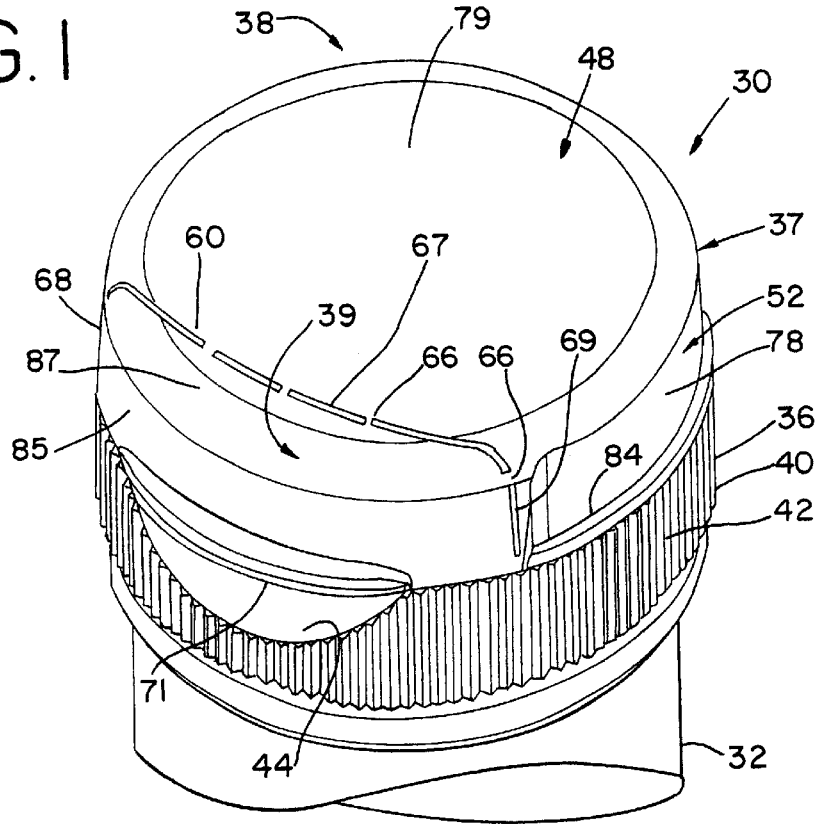
FIG. 1 is a perspective view of a closure structure of the invention mounted on a container neck (container neck shown in fragmentary fashion)

FIG. 1 illustrates a closure structure 30 adapted to be installed on a container neck 32. The closure structure 30 is adapted to be used with a container having a mouth or other opening to provide access to the container interior and to a product contained therein. The closure structure 30 could be used to dispense many types of materials, including, but not limited to, relatively low or high viscosity liquids, particulates, etc. as constituting a food product, a personal care product, an industrial or household cleaning product, or other chemical compositions (e.g., compositions for use in activities involving manufacturing, commercial or household maintenance, construction, agriculture, etc.).

The container with which the closure structure may be used would typically be a squeezable container having a flexible wall or walls which can be grasped by the user and squeezed or compressed to increase the internal pressure within the container so as to force the product out of the container and through the closure structure 30. The container wall typically has sufficient, inherent resiliency so that when the squeezing forces are removed, the container wall returns to its normal, unstressed shape. Such a squeezable wall container is preferred in many applications but may not be necessarily preferred in other applications. For example, in some applications it may be desirable to employ a generally rigid container or even a pressurized container.

The closure structure 30 includes a closure body 36 substantially covered by a cap 37. The body 36 includes an annular body sidewall or body skirt 40 having on an exterior thereof knurling or ribs 42, and a partially circular plain area 44. The cap 37 includes a substantially flat circular end wall 48 and a depending annular cap skirt or cap sidewall 52 The cap 37 includes a lid part 38 and a cover part 39.

The cap includes a perimeter line of weakness 60 formed by a through-cut made discontinuous by intermittent webs or bridges 66, or by a reduced material thickness or notch, or by perforations, or by another known method. The line of weakness 60 has a top segment 67 that extends across the end wall 48 and side segments 68, 69 that extend down the skirt 52 at opposite ends of the top segment 67. The line of weakness defines the intersection of the lid part 38 and the cover part 39.

The cover part 39 provides a lifting tab 71 on a front side thereof, arranged in registry with the plain area 44, the plain area 44 providing a convenient space into which a user can insert a finger to underlie the tab 71 for exerting an upward lifting force.

FIGS. 2 through 16 illustrate further features of the closure structure 30. The lid part 38 is attached to the body 36 via a hinge 76 (FIGS. 3, 5, 12, and 13). The hinge 76 is preferably a snap action hinge. Such a hinge is disclosed in the U.S. Pat. No. 5,642,824, the disclosure of which is incorporated herein by reference thereto. In an alternate embodiment, the lid part 38 need not be connected with a snap-action hinge. A floppy hinge may be used instead.

Figure 2:
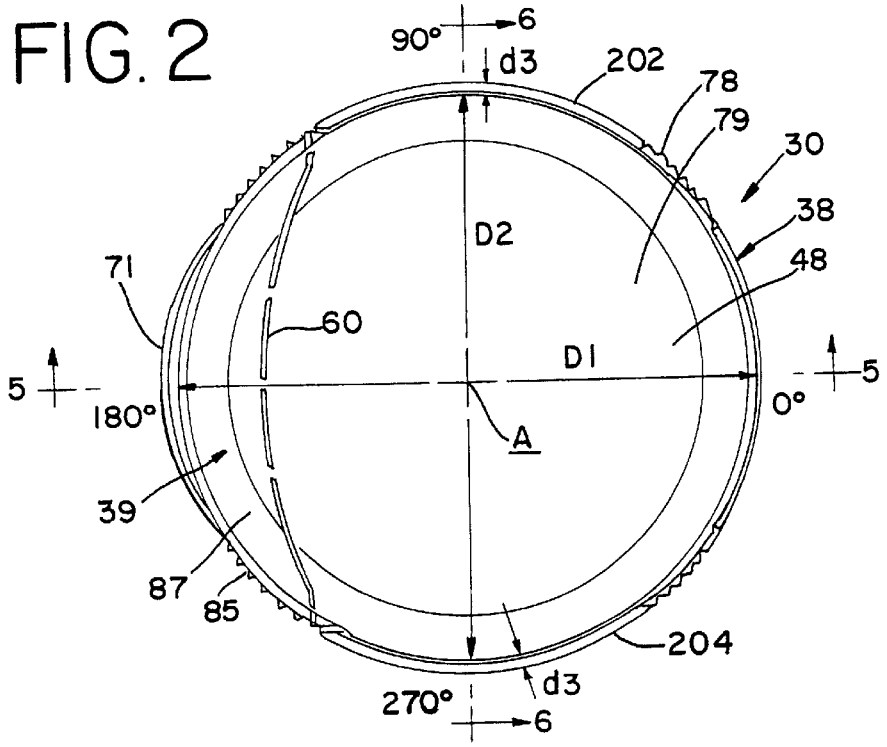
FIG. 2 is a plan view of the closure structure of FIG. 1.

As shown in FIG. 1, the lid part 38 includes a partially annular lid sidewall or lid skirt 78 and a partially circular lid top wall 79. The lid skirt 78 includes side recessed wall portions 82, 84 (FIGS. 4, 6, and 11) which terminate outwardly proximate the cover part 39 (FIG. 2). In this regard, the lid part has a major diameter D1 (FIG. 2) along a line passing from front to back, and a minor diameter D2 along a line passing laterally through the recessed wall portions 82, 84. The difference in diameters accounts for the depths d3 (FIG. 2) of the two recessed wall portions 82, 84.

Figure 3:
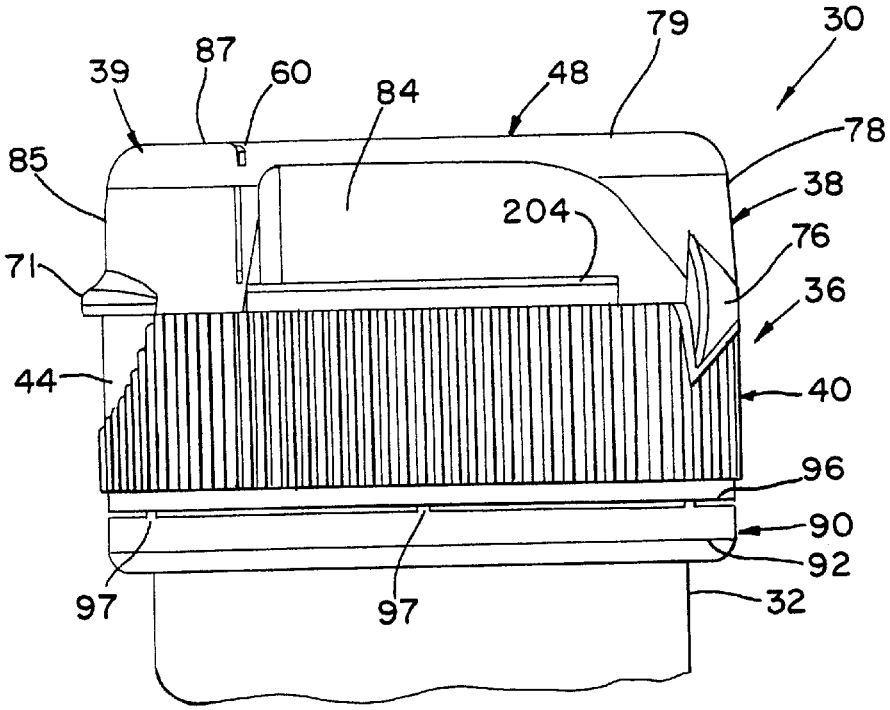
FIG. 3 is a right side view of the closure structure of FIG. 1.
Figure 4:
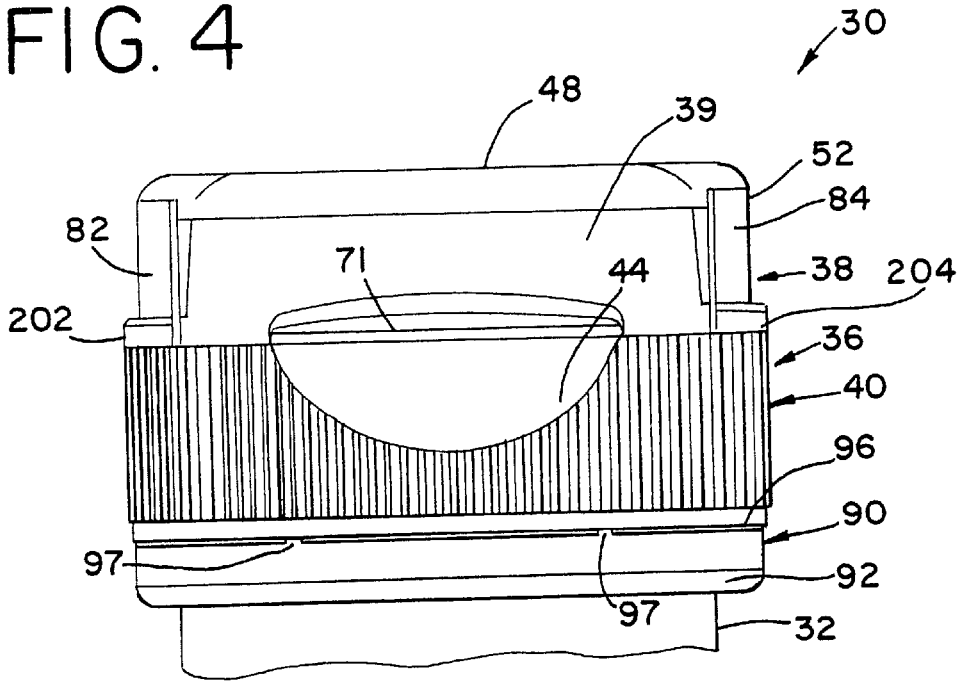
FIG. 4 is a front view of the closure structure of FIG. 1.

As shown in FIGS. 1–3, the cover part 39 includes a partially annular cover sidewall or cover skirt 85 and a partially circular cover top wall 87. The lid sidewall 78 and the cover sidewall 85 form the cap sidewall 52 (FIG. 1). The lid top wall 79 and the cover top wall 87 together form the cap top wall 48 (FIG. 1).

The closure body 36 can include a tamper-evident portion 90 (FIG. 3) on a bottom side thereof for preventing undetected removal of the closure body from the container neck 32. The tamper-evident portion includes a folded locking ring or band 92 (shown in FIGS. 5 and 6) and a frangible joint 96.

This frangible joint 96 includes frangible bridges 97 (FIGS. 3 and 4) integrally connected between the skirt 40 and the downwardly-projecting locking ring 92. The locking ring 92 is engaged to the container neck 32 in such a way that upon first application certain features on the internal surface of the ring engage with features on the outer circumference of the container neck, such as a flange 98 (FIGS. 5 and 6) to prevent its removal. Upon first removal of the closure structure from the container, the interconnecting frangible bridges 97 break and the locking ring remains secured to the container neck, separated visibly and irreplaceably from the closure skirt. Such tamper-evident bands are described for example in U.S. Pat. Nos. 4,196,818 and 5,875,906, the disclosures of which are incorporated by reference thereto.

An additional method to render the closure structure/container connection resistant to unauthorized opening can be to incorporate into the closure body and container finish mating portions a design that prevents the closure body from being removed from the container. This can be accomplished by the use of an appropriately designed snap-on style finish or a one-way, non-removable screw-on finish system. An example of the latter system is described in U.S. Pat. No. 5,494,174.

It should be noted that although an upwardly projecting container "neck" is illustrated for being received within the particular configuration of the closure body 36, the main part of the container (not shown) may have a same or a different cross-sectional shape than the container neck 32 and closure body skirt 40. In this regard, "neck" only refers to that portion of the container that receives the closure structure, and is not limited to a portion which is more narrow than adjoining portions of the container, or the main body of the container. For example, the term "neck" also encompasses the closure-structure-receiving portion of a tubular container, wherein the neck has the same width as the remaining portions of the container.

Figure 5:
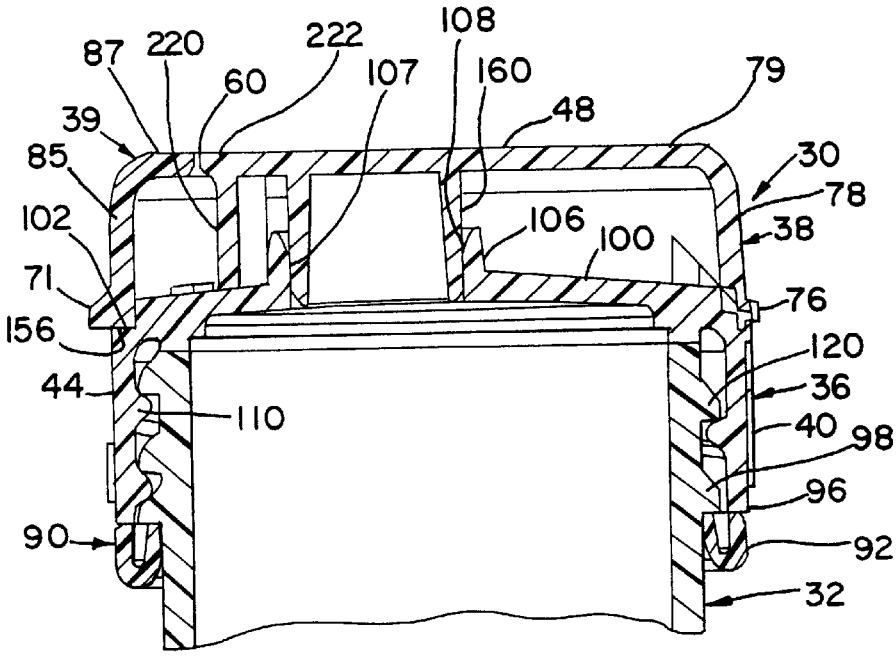
FIG. 5 is a sectional view taken generally along line 5—5 of FIG. 2 of the closure structure as installed on a container neck.
Figure 6:
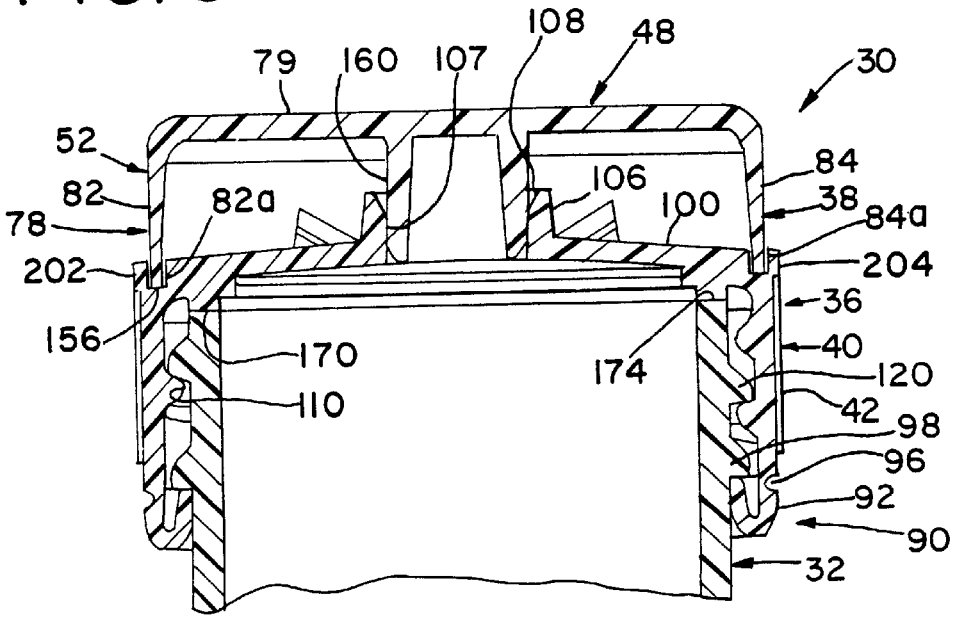
FIG. 6 is a sectional view taken generally along line 6—6 of FIG. 2.

FIGS. 5 and 6 illustrate the internal features of the closure structure 30. The closure structure 30 is adapted to engage the container neck 32. The closure body 36 includes a deck 100 above the sidewall 40. The sidewall 40 is hollow, and generally cylindrical. An annular shoulder 102 (FIG. 5) is defined on top of the body sidewall 40. The closure structure also includes a spout 106 extending upwardly from the deck 100. The spout 106 has a sealing surface 107 that defines a dispensing orifice 108. The interior of the skirt 40 defines an internal thread formation 110. The body sidewall 40 is adapted to receive and threadingly engage the upper end of the container neck 32. The container neck 32 includes an exterior thread formation 120. The skirt thread formation 110 is adapted to matingly engage the thread formation 120 on the container neck.

Alternatively, the body sidewall 40 could be provided with some other container connecting means, such as a snap-fit bead or groove (not illustrated) in place of the thread formation 110 for engaging a container groove or bead (not illustrated), respectively, in the container neck. The closure body 36 could also be permanently attached to the container by means of induction melting, ultrasonic melting, gluing, or the like, depending on materials used for the closure body 36 and in the container. The closure body 36 could also be formed as a unitary part, or extension, of the container.

The closure body skirt 40 may have any suitable configuration. The container could have an upwardly projecting neck or other portion for being received within the particular configuration of the closure body 36, and the main part of the container may have a different cross-sectional shape than the container neck and closure body skirt 40.

The cap sidewall 52 defines at its extremity an annular seating surface 156 (FIG. 5). When the cap 37 is closed, the seating surface 156 engages the annular shoulder 102 defined on the closure body 36.

The lid part 38 includes an orifice sealing member or "spud" 160 (FIGS. 5 and 11) which extends from a lid end wall 48 and which is adapted to sealingly engage the dispensing orifice sealing surface 107 when the lid part 38 is pivoted from the open position (illustrated in FIG. 15) to a closed position (illustrated in FIG. 5). As will be recognized, the orifice sealing member 160 is of a complementary shape relative to the shape of the dispensing orifice 108.

An annular sealing surface 170 is arranged below the deck 100, facing the container neck 32, The surface 170 seals to a complimentary sealing surface 174 of the container neck 32. As an alternative to the annular surface 170, an annular "crab's claw" seal (not shown) could be used which projects downwardly from the closure body deck 100 and is adapted to resiliently engage the sealing surface 174 of the container.

The closure body 36 includes side guard walls 202, 204 (FIGS. 6 and 11) which are located adjacent to the side recessed wall portions 82, 84, respectively (FIG. 6). The guard walls 202, 204 are each spaced from a deck side edge 210 of the deck 100 (FIG. 11), so as to define a partially annular channel 212, 214, respectively (shown in FIGS. 11, 12, and 16), for tight receipt of the respective edge portions 82*a*, 84*a* of the recessed wall portions 82, 84.

Latching mechanisms lock the edge portions 82*a*, 84*a* into the channels 212, 214. Preferably, the latching mechanisms are formed by radially, inwardly extending beads 82*b* (FIGS. 11 and 12), 84*b* (FIG. 12) of the edge portions 82*a*, 84*a*, and radially outwardly extending beads 210*a* (FIG. 14), 210*b* (FIGS. 11 and 14) of the deck side edge 210, which interlock to lock the edge portions 82*a*, 84*a* into the channels 212, 214.

Figure 7:
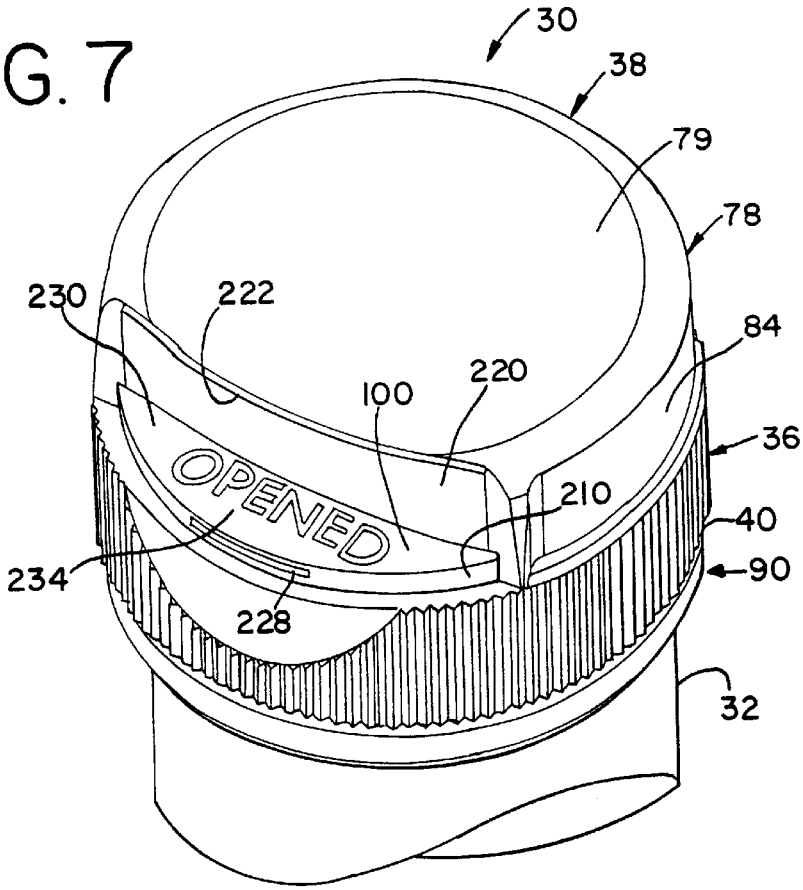
FIG. 7 is a perspective view of the closure structure of FIG. 1, with a tamper-evident feature removed.
Figure 8:
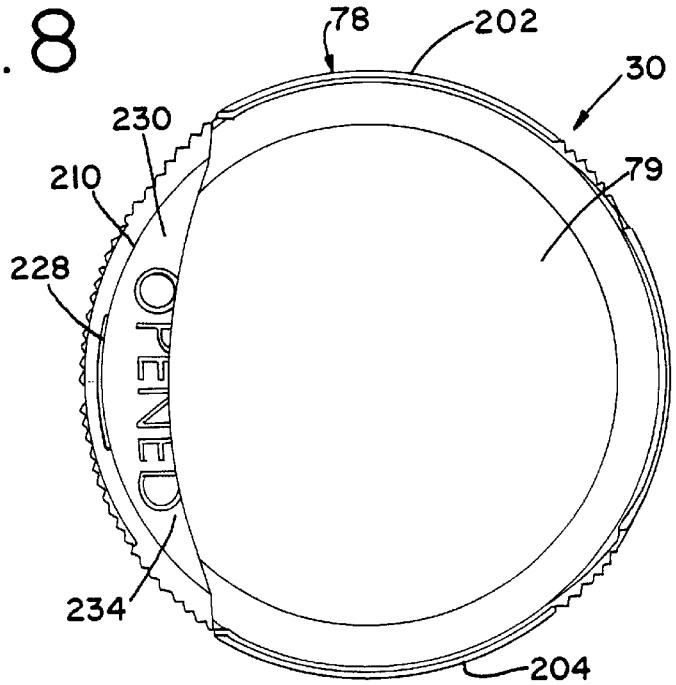
FIG. 8 is a plan view of the closure structure of FIG. 7.
Figure 9:
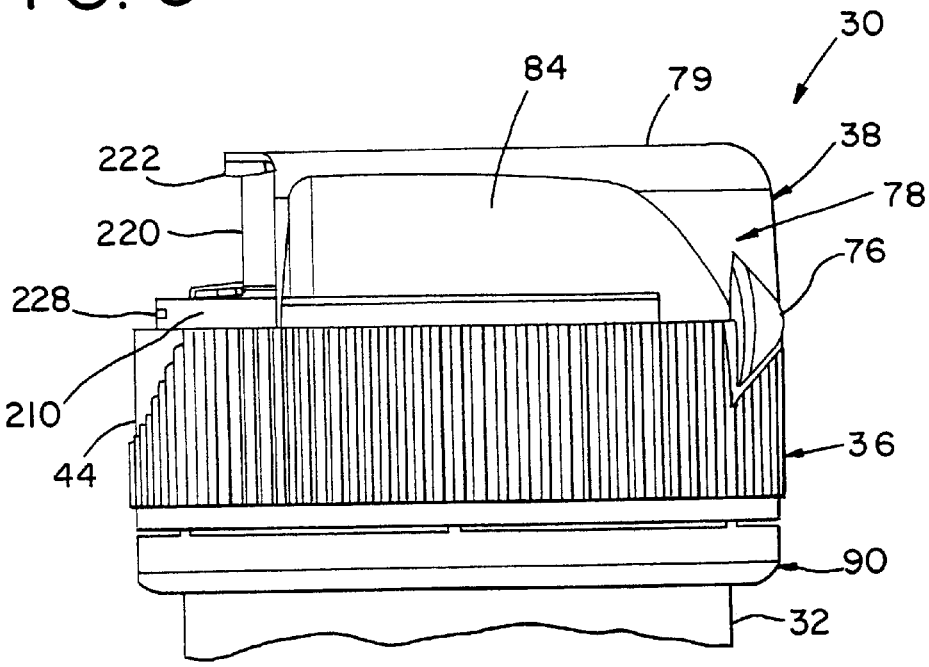
FIG. 9 is a right side view of the closure structure of FIG. 8.
Figure 10:
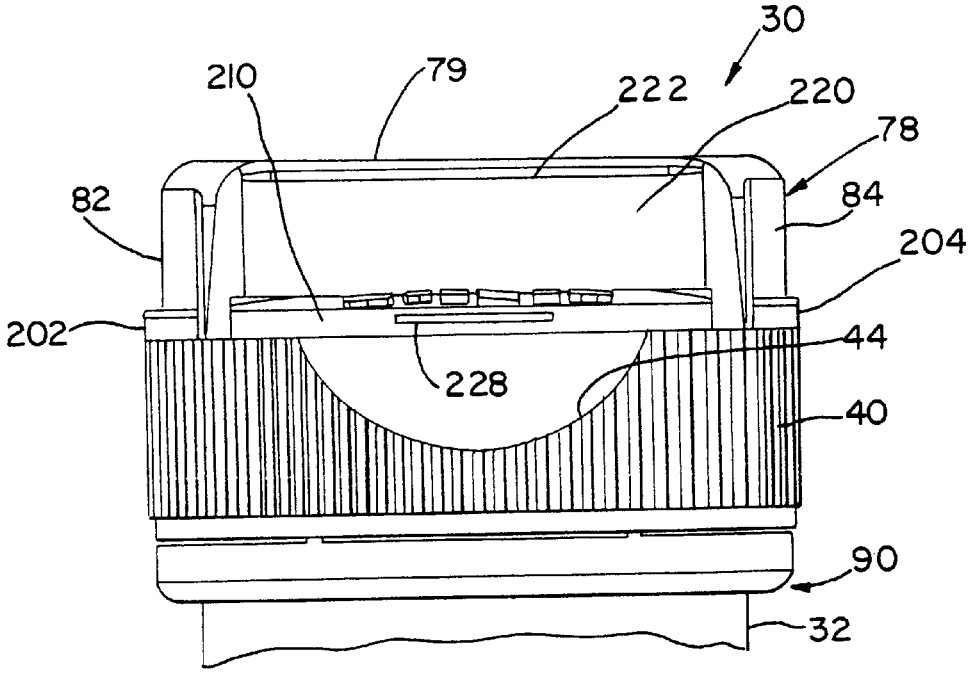
FIG. 10 is a front view of the closure structure of FIG. 8.
Figure 11:
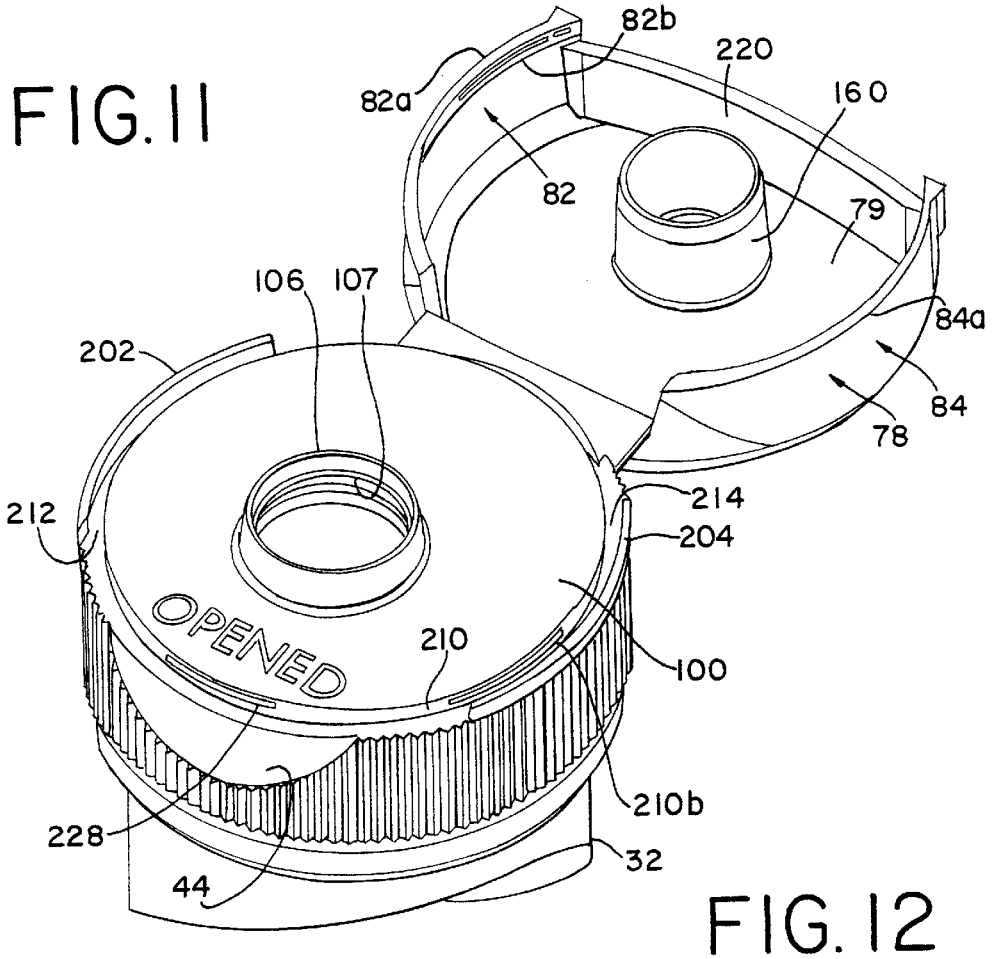
FIG. 11 is a perspective view of the closure structure of FIG. 7 in an open condition.
Figure 12:
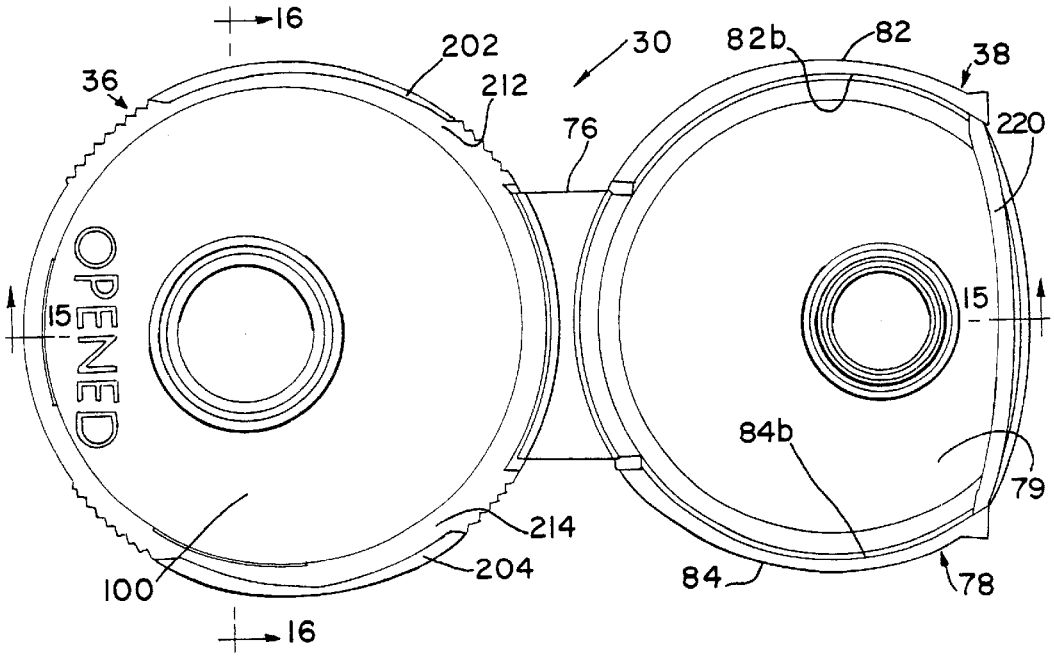
FIG. 12 is a plan view of the closure structure of FIG. 11.
Figure 13:
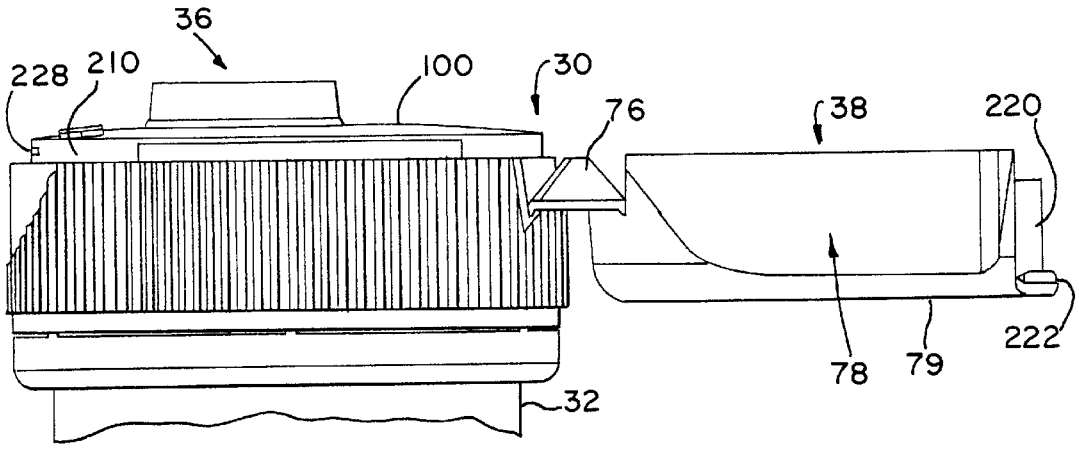
FIG. 13 is a right side view of the closure structure of FIG. 11.
Figure 14:
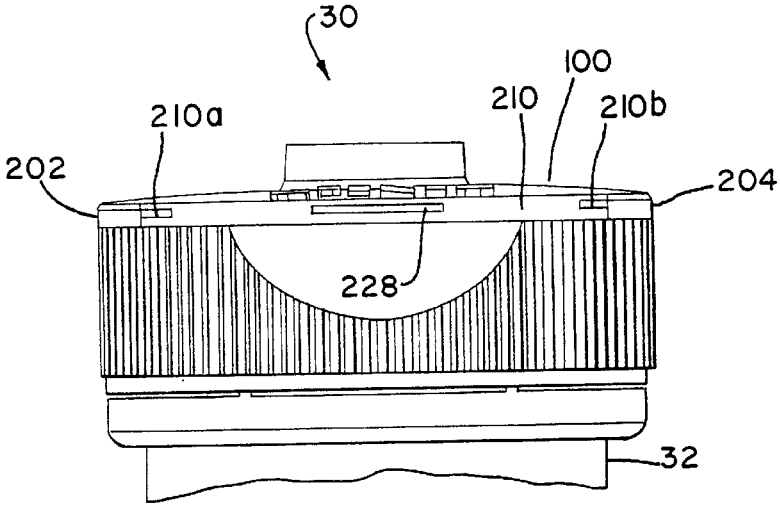
FIG. 14 is a front view of the closure structure of FIG. 11.
Figure 15:
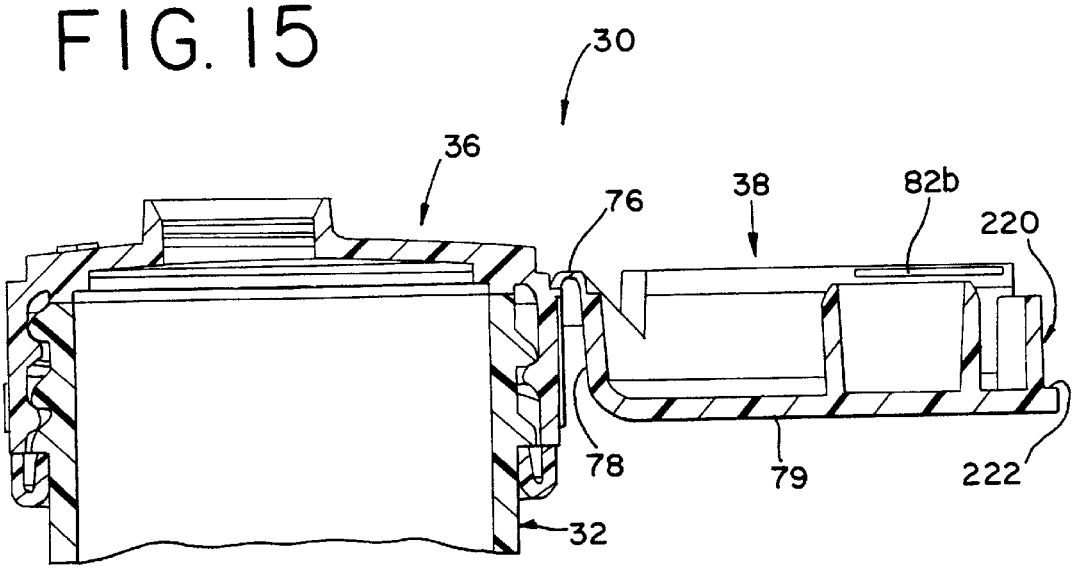
FIG. 15 is a sectional view taken generally along line 15—15 of FIG. 12.
Figure 16:
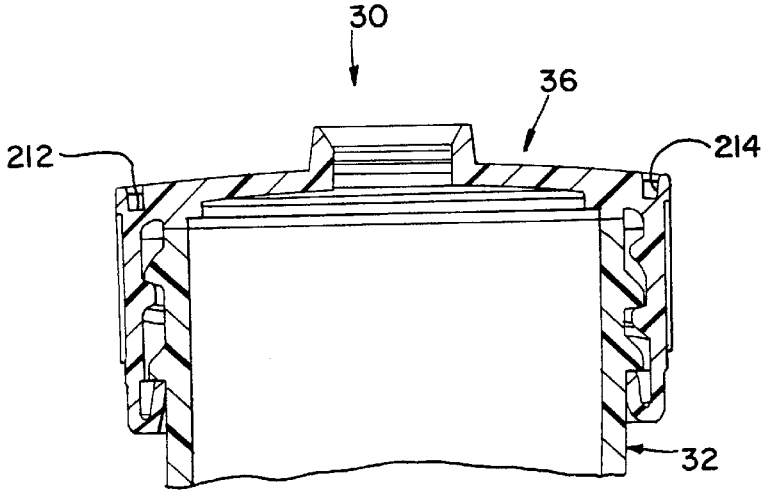
FIG. 16 is a sectional view taken generally along line 16—16 of FIG. 12.

The lid part 38 further includes a recessed front wall 220 (FIG. 11), extending axially downwardly from the top wall 79 and contacting or in close proximity to the deck 100 (FIG. 7). The wall 220 is radially inset from the line of weakness 60, thus forming a lifting lip 222 as shown in FIG. 7.

The cover part 39 is further snap engaged to the deck side edge 210 by a front latching mechanism which preferably includes a radially inwardly extending bead 226 of the cover part 39 which engages a radially outwardly extending bead 228 of the deck side edge 210 (shown in FIGS. 7–10 and 17).

Although the latching mechanism bead pairs 82*b*/210*a*; 84*b*/210*b*; and 226/228 are preferably formed by protruding beads which override and interlock, the scope of the invention also encompasses a groove that could be provided adjacent one or both beads to receive a corresponding opposing bead to increase the integrity of the snap engagement. Furthermore, the invention encompasses other methods of snap engagement latching mechanisms such as bead and groove; pin and hole (or socket); ball and hole (or socket); hook and catch, or other known fastening arrangements.

FIGS. 7–12 show the closure after the cover part 39 has been removed. To remove the cover part 39, a sufficient lifting or pulling force is exerted on the lifting tab 71 (FIG. 1) to exert a sufficient shear or tensile stress to break the webs 66 to separate the cover part 39 from the lid part 38 along the line of weakness 60. Once the cover part 39 is removed, the recessed front wall 220 is exposed, as is the lifting lip 222. The lid part 38 can now be opened by applying a lifting force on the lip 222 to disengage the beads 82*b*, 84*b* from the deck beads 210*a*, 210*b* and pivot the lid part 38 on the body 36 about the hinge 76.

When the lid part 38 and the cover part 39 are latched to the closure body 36, the cap 37 is effectively latched or connected on four sides. Referring back to FIG. 2, the lid part 38 is (1) connected to the closure body at 0 degrees at the hinge 76, (2) latched to the closure body at 90 degrees and 270 degrees via the latching beads pairs 82*b*/210*a* and 84*b*/210*b*, and (3) latched to the closure body at 180 degrees via the front latching beads 226/228, all recited angles being defined about a central vertical axis A of the closure 30 as shown in FIG. 2. The only exposed prying surface to lift the cap 37 from the body 36 is the cover part lifting tab 71.

The cover part 39 is arranged to be lifted at the 180 degree position at the lifting tab 71. Lifting or pulling the lifting tab 71 disengages the beads 226/228, breaking the side segments 68, 69 of the frangible line of weakness 60, while pivoting the cover part 39 about the top segment 67 of the frangible line of weakness. The cover part 39 can be torn or broken from the lid part 38 along the top segment 67. Removal of the cover part exposes, and allows prying up of, the lifting lip 222 and pivoting of the lid part 38 about the hinge 76 to disengage the bead connections at 90 degrees and 270 degrees.

With the cover part removed, a crescent-shaped portion 230 (FIG. 7) of the deck 100 is exposed. This portion 230 can carry information, such as in the form of molded indicia 234 indicating the lid part may have been opened, or other information or displays.

FIGS. 17 and 18 illustrate an alternate embodiment closure structure 300. In this embodiment, an alternate lid part 338 includes a substantially straight (non-recessed) sidewall. The body 336 does not include guard walls. In this embodiment, the lid skirt is made sufficiently rigid to resist undetected disengagement of the side beads caused by a radially exerted force. Also, the first embodiment closure body/container neck tamper-evident element 90 (FIG. 5) is omitted in this embodiment.

It will be readily apparent from the foregoing detailed description of the invention and from the illustrations thereof that numerous variations and modifications may be effected without departing from the true spirit and scope of the novel concepts or principles of this invention. For example, although the closure structure of the invention is exemplified by a threaded engagement with the container, the invention contemplates other fastening techniques and implements for securing the closure structure to the container. Other fastening might incorporate a friction fit facilitated by a closure structure having a skirt with an inside diameter sized to provide a sliding or telescoping engagement with a smooth, threadless container finish. In such an embodiment, the fitment and closure body would be provided with abutment surfaces, for example, a bayonet type interlock or fastening implement, which permit installation of the closure structure on the container, but which may be configured, for example, by relative rotation of the closure body and container, to restrict upward movement of the closure body relative to the container.

What is claimed is:

1. A closure structure comprising:

a closure body having a deck and depending sidewall, and a dispensing orifice through said deck; and a closure cap having a lid part attached to said body at a hinged attachment, and a cover part frangibly connected to said lid part on a side of said lid part opposite said hinged attachment to said body, said lid part latched to said body at lateral positions located between said hinged attachment and said cover part, said cover part covering a lifting lip extending from said lid part, removal of said cover part exposing said lifting lip, said cover part comprising a first front latching bead and said body comprises a second front latching bead, said first and second front latching beads engageable to latch said cover part to said body.

2. A closure structure comprising:

a closure body having a deck and depending sidewall, and a dispensing orifice through said deck; and a closure cap having a lid part attached to said body at a hinged attachment, and a cover part frangibly connected to said lid part on a side of said lid part opposite said hinged attachment to said body, said lid part comprising first side latching beads along side edges thereof, said lid part latched to said body at lateral positions located between said hinged attachment and said cover part, said cover part covering a lifting lip extending from said lid part, removal of said cover part exposing said lifting lip, said body comprising side guard walls preventing outward side displacement of said first side latching beads of said lid part.

3. A closure structure comprising:

a closure body having a deck and depending sidewall, and a dispensing orifice through said deck; and a closure cap having a lid part attached to said body at a hinged attachment, and a cover part frangibly connected to said lid part on a side of said lid part opposite said hinged attachment to said body, said lid part latched to said body at lateral positions located between said hinged attachment and said cover part, said cover part covering a lifting lip extending from said lid part, removal of said cover part exposing said lifting lip, said lid part comprising a first top wall, a depending first partially annular skirt bridged by a substantially planar front wall, and said cover part comprising a second top wall and second partially annular skirt, said first and second partially annular skirts completing a cap annular sidewall, and said first and second top walls completing a cap top wall.

4. The closure structure according to claim 3, wherein said lid part comprises a latching formation at opposed side positions on an edge of said first partially annular skirt, and said cover part comprises a coacting latching formation at a front position on an edge of said second partially annular skirt.

5. A closure structure comprising:

a closure body having a deck and depending sidewall, and a dispensing orifice through said deck; and a closure cap having a lid part attached to said body at a hinged attachment, and a cover part frangibly connected to said lid part on a side of said lid part opposite said hinged attachment to said body, said lid part latched to said body at lateral positions located between said hinged attachment and said cover part, said cover part covering a lifting lip extending from said lid part, removal of said cover part exposing said lifting lip, said cap comprising a top wall and an annular sidewall, and said lid part and said cover part of said cap being frangibly connected by a line of weakness having a top segment extending across the top wall and side segments extending down said annular sidewall from opposite ends of said top segment.

6. A closure structure comprising:

a closure body having a deck and depending sidewall, and a dispensing orifice through said deck; and a closure cap having a lid part attached to said body at a hinged attachment, and a cover part frangibly connected to said lid part on a side of said lid part opposite said hinged attachment to said body, said lid part latched to said body at lateral positions located between said hinged attachment and said cover part, said cover part covering a lifting lip extending from said lid part, removal of said cover part exposing said lifting lip, said body comprising side channels, said lid part having side edge portions engaged into said side channels, said side edge portions and said side channels having latching elements for latching said side edge portions into said side channels.

7. A closure structure comprising:

a closure body having a deck and depending sidewall, and a dispensing orifice through said deck; and a closure cap having a lid part attached to said body at a hinged attachment, and a cover part frangibly connected to said lid part on a side of said lid part opposite said hinged attachment to said body, said lid part latched to said body at lateral positions located between said hinged attachment and said cover part, said cover part covering a lifting lip extending from said lid part, removal of said cover part exposing said lifting lip, said cover part comprising a lifting tab and a first front latching element, and said body comprising a second front latching element, said first front latching element for latching said cover part to said second front latching element, said first and second latching elements disengageable by a user-applied lifting force on said tab.

* * * * *